US007195658B2

(12) United States Patent
Swei et al.

(10) Patent No.: US 7,195,658 B2
(45) Date of Patent: Mar. 27, 2007

(54) ANTILOADING COMPOSITIONS AND METHODS OF SELECTING SAME

(75) Inventors: Gwo S. Swei, Vandalia, OH (US); Damien C. Nevoret, Worcester, MA (US); Patrick Yang, Ballston Lake, NY (US)

(73) Assignee: Saint-Gobain Abrasives, Inc., Worcester, MA (US)

( * ) Notice: Subject to any disclaimer, the term of this patent is extended or adjusted under 35 U.S.C. 154(b) by 100 days.

(21) Appl. No.: 10/688,833

(22) Filed: Oct. 17, 2003

(65) Prior Publication Data

US 2005/0085167 A1 Apr. 21, 2005

(51) Int. Cl.
*B24D 3/00* (2006.01)
*B24D 11/00* (2006.01)

(52) U.S. Cl. ..... 51/298; 51/307; 51/308; 51/309; 51/295; 51/297

(58) Field of Classification Search ..... 51/307, 51/508, 295, 297, 298, 308, 309
See application file for complete search history.

(56) References Cited

U.S. PATENT DOCUMENTS

| | | | |
|---|---|---|---|
| 2,768,886 | A | 10/1956 | Twombly |
| 2,893,854 | A | 7/1959 | Rinker et al. |
| 3,619,150 | A | 11/1971 | Rinker et al. |
| 4,396,403 | A | 8/1983 | Ibrahim |
| 4,609,380 | A | 9/1986 | Barnett et al. |
| 4,784,671 | A | 11/1988 | Elbel |
| 4,973,338 | A | 11/1990 | Gaeta et al. |
| 4,988,554 | A | 1/1991 | Peterson et al. |
| 5,039,311 | A | 8/1991 | Bloecher |
| 5,061,294 | A | 10/1991 | Harmer et al. |
| 5,152,809 | A | 10/1992 | Mattesky |
| 5,164,265 | A | 11/1992 | Stubbs |
| 5,213,589 | A | 5/1993 | Ronning et al. |
| 5,328,716 | A | 7/1994 | Buchanan |
| 5,578,097 | A | 11/1996 | Gaeta et al. |
| 5,667,542 | A | 9/1997 | Law et al. |

(Continued)

FOREIGN PATENT DOCUMENTS

| | | |
|---|---|---|
| EP | 0 433 031 A1 | 6/1991 |

(Continued)

*Primary Examiner*—Michael A. Marcheschi
(74) *Attorney, Agent, or Firm*—Hamilton, Brook, Smith & Reynolds, P.C.; Joseph P. Sullivan, Esq.

(57) ABSTRACT

An antiloading composition includes a first organic compound. The compound has a water contact angle criterion that is less than a water contact angle for zinc stearate. The first compound also satisfies at least one condition selected from the group consisting of a melting point $T_{melt}$ greater than about 40° C., a coefficient of friction F less than about 0.3, and an antiloading criterion P greater than about 0.3. Another embodiment includes a second organic compound, having a different water contact angle from that of the first organic compound. The composition has a particular water contact angle $W°_p$ that is determined, at least in part, by the independent $W°_g$ of each compound and the proportion of each compound in the composition. Also, an abrasive product includes the antiloading composition. A method of grinding a substrate is disclosed that includes employing effective amount of an antiloading composition. Further disclosed is a method of selecting an antiloading compound.

6 Claims, 2 Drawing Sheets

U.S. PATENT DOCUMENTS

| | | | | |
|---|---|---|---|---|
| 5,704,952 | A | 1/1998 | Law et al. | |
| 5,914,299 | A | 6/1999 | Harmer et al. | |
| 5,954,844 | A | 9/1999 | Law et al. | |
| 6,261,682 | B1 * | 7/2001 | Law | 428/343 |
| 6,299,520 | B1 | 10/2001 | Cheyne, III | |
| 6,312,315 | B1 | 11/2001 | Gagliardi | |

FOREIGN PATENT DOCUMENTS

| | | | |
|---|---|---|---|
| EP | 0 398 580 | B1 | 9/1994 |
| WO | WO 97/42006 | A1 | 11/1997 |
| WO | WO 97/42007 | A1 | 11/1997 |
| WO | WO 00/00327 | A1 | 1/2000 |
| WO | WO 02/062531 | A1 | 8/2002 |

* cited by examiner

ANTILOADING COMPOSITIONS AND METHODS OF SELECTING SAME

BACKGROUND OF THE INVENTION

Generally, abrasive products comprise abrasive particles bonded together with a binder to a supporting substrate. For example, an abrasive product can comprise a layer of abrasive particles bound to a substrate, where the substrate can be a flexible substrate such as fabric or paper backing, a non-woven support, and the like. Such products are employed to abrade a variety of work surfaces including metal, metal alloys, glass, wood, paint, plastics, body filler, primer, and the like.

It is known in the art that abrasive products are subject to "loading", wherein the "swarf", or abraded material from the work surface, accumulates on the abrasive surface and between the abrasive particles. Loading is undesirable because it typically reduces the performance of the abrasive product. In response, "antiloading" compositions have been developed that reduce the tendency of an abrasive product to accumulate swarf. For example, zinc stearate has long been known as a component of antiloading compositions. Many classes of compounds have been proposed as components of antiloading compositions. For example, some proposed components of antiloading compositions can include long alkyl chains attached to polar groups, such as carboxylates, alkylammonium salts, borates, phosphates, phosphonates, sulfates, sulfonates, and the like, along with a wide range of counter ions including monovalent and divalent metal cations, organic counterions, such as tetraalkylammonium, and the like.

However, there is no known teaching in the art as to which of this large class of compounds are effective antiloading agents, short of manufacturing an abrasive product with each potential compound and performing a time consuming series of abrasion tests. Many proposed compounds are actually ineffective antiloading agents.

Furthermore, some agents known to be effective for antiloading result in unacceptable contamination of the work surface, e.g., commonly leading to defects in a subsequent coating step. For example, use of zinc stearate in finishing abrasives in the auto industry leads to contamination of the primer surface, requiring an additional cleaning step to prepare the primer for a subsequent coat of paint.

Also, some antiloading agents that are known to be effective, such as zinc stearate, are insoluble in water. As a result, manufacturing an abrasive product with a water-insoluble antiloading agent can require organic solvents or additional additives and/or processing steps.

Thus, there is a need for antiloading agents that are effective, that are easily incorporated into an abrasive product, and that minimize contamination of the work surface. Further, there is a need for a method of selecting effective antiloading compounds.

SUMMARY OF THE INVENTION

It has now been found that certain compounds can be effective antiloading agents, particularly compounds, such as anionic surfactants, that satisfy certain criteria, as demonstrated in Examples 1–5.

An antiloading composition includes a first organic compound. The compound has a water contact angle criterion $W°_g$ that is less than a water contact angle $W°_z$ for zinc stearate. The first compound satisfies at least one condition selected from the group consisting of a melting point $T_{melt}$ greater than about 40° C., a dynamic coefficient of friction F less than about 0.5, and an antiloading criterion P greater than about 0.2.

Another embodiment includes a second organic compound, having a $W°_g$ different from that of the first organic compound. The composition has a particular water contact angle $W°_p$ that is determined, at least in part, by the independent $W°_g$ of each compound and the proportion of each compound in the composition.

An abrasive product includes the antiloading composition.

A method of grinding a substrate includes grinding a work surface by applying an abrasive product to the work surface to create work surface swarf, and providing an effective amount of an antiloading composition at the interface between the abrasive product and the work surface swarf.

Another embodiment of the method includes grinding the substrate to a particular water contact angle $W°_p$ by employing the second organic compound.

A method of selecting an antiloading compound includes selecting the first organic compound. Another embodiment of the method includes selecting the second compound, and determining a proportion for each compound, whereby a composition comprising the compounds in the proportions has a particular water contact angle $W°_p$ that is due, at least in part, to the $W°_g$ of each compound and the proportion thereof.

The advantages of the embodiments disclosed herein are significant. By providing effective antiloading compositions, the efficiency and effectiveness of abrasion products and methods are improved, thereby reducing the cost and improving the quality of the work product. By providing antiloading compositions which lead to ground surfaces with decreased water contact angles $W°_g$, the manufacture of abrasive products incorporating antiloading compositions is eased, and the contamination of work surfaces is reduced, particularly for work surfaces to be coated after abrasion, e.g., with paint, varnish, powder coat, and the like. By providing antiloading compositions that are effective at a range of temperatures, work surfaces at different temperatures can be abraded without requiring temperature modification and/or multiple products for different temperatures. Furthermore, by grinding a work surface to a particular water contact angle $W°_p$, the ground surface can be "fine-tuned" to be compatible with a subsequent coating. The result is a significant improvement in the versatility, quality, and effectiveness of abrasion products, methods, and work product produced therefrom.

DETAILED DESCRIPTION OF THE INVENTION

The disclosed embodiments are generally related to additives used to increase the effectiveness of abrasive products, in particular, antiloading compositions that are incorporated into abrasive products. A description of various embodiments of the invention follows.

As used herein, an "antiloading composition" includes any organic compound or salt thereof that can be an effective antiloading agent with respect to the particular combinations of two or more of the criteria disclosed herein, such as P, F, $T_{melt}$, ΔT, $T_{sub}$, W°, $W°_g$, $W°_z$, $W°_p$, and the chemical structure of the agent.

Figure 1:
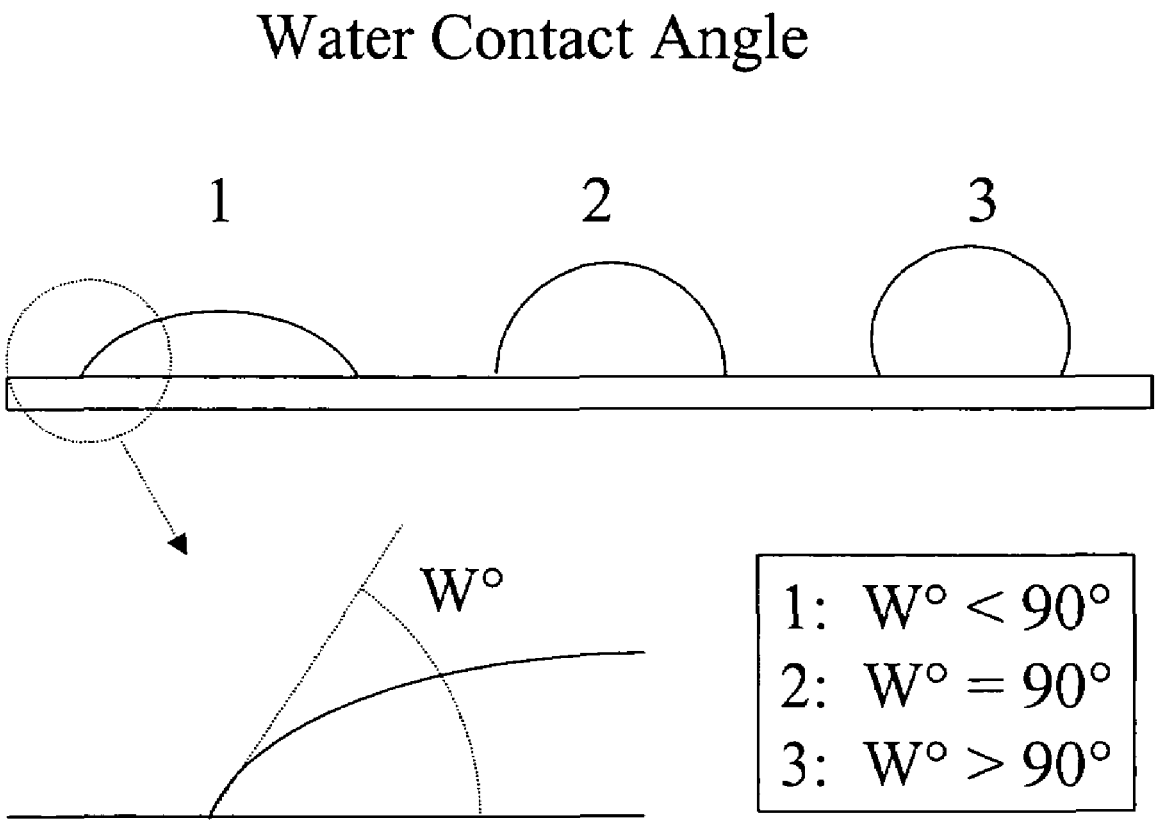
FIG. 1 depicts a schematic representation of the measurement of water contact angle.

As used herein, a water contact angle, e.g., water contact angles W°, $W°_g$, $W°_z$, and $W°_p$, can be determined by one skilled in the art by the method of goniometry. When water is applied to a substrate, the water contact angle is the angle between the plane of the substrate and a line tangent to the surface of the water at the intersection of the water and the substrate. FIG. 1 illustrates, for example, water contact angles for values of W° less than 90°, equal to 90°, and greater than 90°. This angle can be read by a goniometer. Further experimental details for determining the water contact angle are provided in Example 4.

As used herein, the substrate can be any material ground or polished in the art, e.g., wood, metal, plastics, composites, ceramics, minerals, and the like; and also coatings of such substrates including paints, primers, varnishes, adhesives, powder coats, oxide layers, metal plating, contamination, and the like. A substrate typically includes metal, wood, or polymeric substrates, either bare or coated with protective primers, paints, clear coats, and the like.

As used herein, W° is the water contact angle measured for an un-ground substrate. $W°_g$ is the water contact angle measured for a substrate ground in the presence of an effective amount of an antiloading compound, e.g., the first organic compound. An "effective amount" is an amount of antiloading compound or antiloading composition sufficient to have an antiloading effect when present during grinding of a substrate. $W°_z$ is the water contact angle measured for a substrate ground in the presence of an effective amount of zinc stearate. When two such values are compared, e.g., when $W°_g$ is less than $W°_z$, it can mean that the respective water contact angles are measured for identical substrates ground with identical abrasives in the presence of an effective amount of each respective compound, e.g., the first organic compound and zinc stearate.

In various embodiments, $W°_g$ for the first compound is less than $W°_z$, typically less than about 125°, more typically less than about 110°, still more typically less than about 100°, yet more typically less than about 70°, or less than about 50°. In a particular embodiment, $W°_g$ for the first compound is about 0°.

In various embodiments, a particular water contact angle $W°_p$, can be desirable, e.g., if it is an angle that can not be easily achieved by employing a single antiloading compound, or it is an angle that can be easily achieved by employing a single compound that is undesirable for other reasons, e.g., cost, toxicity, antiloading performance, and the like. A composition can contain two or more compounds with different values for $W°_g$, combined in a proportion that can achieve the particular water contact angle $W°_p$. When two compounds are employed, at least one compound, e.g., the first organic compound, satisfies the minimum antiloading criteria, e.g., $W°_g$ is less than $W°_z$ and at least one condition is satisfied from a melting point $T_{melt}$ greater than about 40° C., a coefficient of friction less than about 0.6, and an antiloading criterion P greater than about 0.3. The second compound can be any effective antiloading compound, for example, the second compound can be zinc stearate. In particular embodiments, both the first and the second organic compound satisfy the minimum antiloading criteria, e.g., $W°_g$ is less than $W°_z$ and at least one condition is satisfied from a melting point $T_{melt}$ greater than about 40° C., a coefficient of friction less than about 0.6, and an antiloading criterion P greater than about 0.3.

In a particular embodiment, the particular angle $W°_p$ can be selected to match a subsequent coating, which can reduce defects due to contamination by the antiloading compound. For example, a water-based coating can perform better when the surface is prepared with a lower $W°_p$ compared to a surface prepared for an oil based coating. For particular coatings that can be very sensitive to $W°_p$, e.g., an emulsion based coating, the $W°_p$ can be selected to be about the optimal value for the coating. In various embodiments, the two or more compounds can be employed together, e.g., as a composition included in the abrasive, or a composition applied to the abrasive, the work surface, or both. In other embodiments, the compounds can be employed separately, e.g., at least one compound can be included in the abrasive product, or applied to the work surface, or the abrasive, and the like. For example, the abrasive can contain at least one compound, and the second compound can be applied to the work surface using, e.g., a solution of an antiloading agent, applied by, for example, a spray gun which can be controlled to apply particular amounts. Thus, a single abrasive can be employed between multiple coatings, and the value of $W°_p$ after each grinding operation can be adjusted by the amount of the second compound that is employed.

As used herein, the melting point, $T_{melt}$, of the compound can be determined by one skilled in the art by the method of differential scanning calorimetry (DSC). Further experimental details are provided in Example 3. One skilled in the art can appreciate that in this context, the term "melting point" refers to a thermal transition in the DSC plot that indicates softening of the compound, i.e., the melting point of a crystalline compound, the softening or liquefaction point of an amorphous compound, and the like. In various embodiments, the melting point of the compound is greater than about 40° C., or more typically greater than about 55° C., or alternatively, greater than about 70° C. In particular embodiments, the melting point is greater than about 90° C. .

The coefficient of friction F for a compound can be determined by preparing coated samples and measuring the coefficient of friction at 20° C. Experimental details for determining F are provided in Example 2. In various embodiments, the value of F for the compound is less than about 0.6, more typically less than about 0.4, or alternatively, less than about 0.3. In a particular embodiment, the value of F is less than about 0.2.

The antiloading criterion P can be calculated by Eq (1):

$$P=0.68-2.07*F+(3.3E-3*\Delta T)+1.58*F^2 \quad (1)$$

In Eq (1), variable ΔT, in units of ° C., is the difference $T_{melt}-T_{sub}$, where $T_{melt}$ is the melting point of the compound and $T_{sub}$ is the temperature of the substrate being ground. The temperature of the substrate, $T_{sub}$, can be measured by measuring the temperature of the work surface by employing a thermometer, thermocouple, or other temperature measuring devices well known to one skilled in the art. In various embodiments, the value of $T_{sub}$, as employed to calculate ΔT and P, can be from about 20° C. to about 45° C., or more typically from about 20° C. to about 45° C. In a particular embodiment, $T_{sub}$ is about 45° C.

For example, in various embodiments, the antiloading criterion P has a value of greater than about 0.2, or alternatively greater than about 0.3. In a particular embodiment, P is greater than about 0.5. Further details for antiloading criterion P are provided in Example 5 and in FIG. 2.

In various embodiments, the variable ΔT is greater than about 20° C., typically greater than about 30° C., more typically greater than about 40° C., or alternatively greater than about 50° C. In a particular embodiment, ΔT is greater than about 75° C.

One skilled in the art can appreciate that many abrading applications can occur at temperatures above ambient temperature, i.e., greater than about 20° C., due to frictional heating, workpiece baking, and the like. For example, in the automotive industry, during the painting process, a car body typically goes through a paint coating station. The car body can typically be heated to greater than ambient temperature at a paint station, which can be as high as about 43° C. As it exits the station, operators can inspect the body for defects, and identified defects can be abraded.

One skilled in the art can also appreciate that in testing to select effective antiloading compounds, the particular temperatures employed in the test to calculate P do not limit, per se, the temperatures that a selected compound can be used at. For example, a compound that is tested at 45° C. can be used at temperatures that are higher or lower than 45° C.

One skilled in the art can appreciate that certain antiloading agents, e.g., zinc stearate, can have high values for P. However, one skilled in the art can also appreciate that many applications of abrasive products can be contaminated by an antiloading agent that increases the water contact angle of the substrate. For example, if zinc stearate was employed on a surface to be coated with a water-based coating, residual zinc stearate would probably need to be removed from the abraded surface or the coating can be less effective at adhering to the surface.

The compounds, e.g., organic compounds that can be effective antiloading agents typically include surfactants or molecules with surfactant-like properties, i.e., molecules with a large hydrophobic group coupled to a hydrophilic group, e.g., anionic surfactants. Typical hydrophobic groups include branched or linear, typically linear aliphatic groups of between about 6 and about 18 carbons. Hydrophobic groups can also include cycloaliphatic groups, aryl groups, and optional heteroatom substitutions. Typical hydrophilic groups include polar or easily ionized groups, for example: anions such as carboxylate, sulfate, sulfonate, sulfite, phosphate, phosphonate, phosphate, thiosulfates, thiosulfite, borate, and the like. For example, an anionic surfactant includes a molecule with a long alkyl chain attached to an anionic group, e.g., the C12 alkyl group attached to the sulfate anion group in sodium dodecyl sulfate.

Thus, for example, anionic surfactants that can be effective antiloading agents include compounds of the general formula R—A-$M^+$, where R is the hydrophobic group, $A^-$ is the anionic group, and $M^+$ is a counterion. One skilled in the art can appreciate that acceptable variations of the formula include stoichiometric combinations of ions of different or identical valences, e.g., $(R—A^-)_2M^{++}$, $R—A^{--}(M^+)_2$, $R—A^{--}H^+M^+$, $R—A^{--}M^{++}$, and the like.

R can be a C6–C18 branched or linear, typically linear aliphatic group. R can optionally be interrupted by one or more interrupting groups, and/or be substituted, provided that the resulting compound continues to be an effective antiloading agent according to the criteria disclosed herein. Suitable substituents can include, for example, —F, —Cl, —Br, —I, —CN, —$NO_2$, halogenated C1–C4 alkyl groups, C1–C6 alkoxy groups, cycloalkyl groups, aryl groups, heteroaryl groups, heterocyclic groups, and the like. Suitable interrupting groups can include, for example, —O—, —S—, —(CO)—, —$NR^a$(CO)—, —$NR^a$—, and the like, wherein $R^a$ is —H or a small, e.g., C1–C6, alkyl group, or alternatively, an aryl or aralkyl group, e.g., phenyl, benzyl, and the like.

Counterion $M^+$can form a salt with the compound and can be, for example, a metal cation, e.g., $Mg^{++}$, $Mn^{++}$, $Zn^{++}$, $Ca^{++}$, $Cu^{++}$, $Na^+$, $Li^+$, $K^+$, $Cs^+$, $Rb^+$, and the like, or a non-metallic cation such as sulfonium, phosphonium, ammonium, alkylammonium, arylammonium, imidazolinium, and the like. In one embodiment, $M^+$ can be a metal ion. In another embodiment, $M^+$ is an alkali metal ion, e.g., $Na^+$, $Li^+$, $K^+$, $Cs^+$, or $Rb^+$. In a particular embodiment, $M^+$ is $Na^+$.

The anionic group depicted by $A^-$ can include, for example carboxylate, sulfate, sulfonate, sulfite, sulfosuccinate, sarcosinate, sulfoacetate, phosphate, phosphonate, phosphate, thiosulfate, thiosulfite, borate, and the like. $A^-$ can also include carboxylate, sulfate, sulfonate, phosphate, sarcosinate, sulfoacetate, or phosphonate. Alternatively, the anionic group can be sulfate, sarcosinate, sulfoacetate, or betaine (e.g., trimethylglycinyl, e.g., a carboxylate). In another embodiment, the anionic group can be sulfate.

One skilled in the art will know that a sample of such molecules typically can include a distribution among neutral, i.e., protonated or partially or fully esterified forms, For example, a carboxylate surfactant could include one or more of the species $R—CO_2^-M^+$, $R—CO_2H$, and $R—CO_2R^b$, wherein $R^b$ is a small, e.g., C1–C6, alkyl group, a benzyl group, and the like.

Thus, in various embodiments, the compound can include, for example, compounds represented by formulas $R—OSO_3^-M^+$, $R—CONR'CH_2CO_2^-M^+$, $R—O(CO)CH_2OSO_3^-M^+$, or $RCONH(CH_2)_3N+(CH_3)_2CH_2COO—$ wherein R is C6–C18 linear alkyl; R' is C1–C4 linear alkyl; and $M^+$ is an alkali metal ion. In other embodiments, the compound can include sodium lauryl sulfate, sodium decyl sulfate, sodium octyl sulfate, lauramidopropyl betaine, and sodium lauryl sulfoacetate. In a particular embodiment, the compound can be sodium lauryl sulfate.

As used herein, an abrasive material is any particulate ceramic, mineral, or metallic substance known to one skilled in the art that is employed to grind workpieces. For example, abrasive materials can include alpha alumina (fused or sintered ceramic), silicon carbide, fused alumina/zirconia, cubic boron nitride, diamond and the like as well as combinations thereof. Abrasive materials are typically affixed to a support substrate, (e.g., a fabric, paper, metal, wood, ceramic, or polymeric backing); a solid support, (e-g., a grinding wheel, an "emery board"), and the like. The material is affixed by combining a binder, e.g., natural or synthetic glues or polymers, and the like with the abrasive material and the support substrate, and the combination is then cured and dried. The antiloading composition can be combined with these elements at any stage of fabricating the abrasive product. In one embodiment, the antiloading composition is combined with the binder and abrasive material during manufacture of the abrasive product. In other embodiments, the antiloading composition is at the interface between the abrasive surface of the final product and the work surface swarf, e.g., by applying the antiloading composition to the abrasive surface at manufacture, applying the antiloading composition to the abrasive surface, applying the compound to the work surface, combinations thereof, and the like.

The abrasive product, e.g., in the form of nowoven abrasives, or coated abrasives, e.g., sandpaper, a grinding wheel, a disc, a strip, a sheet, a sanding belt, a compressed grinding tool, and the like, can be employed by applying it to the work surface in a grinding motion, e.g., manually, mechanically, or automatically applying the abrasive, with pressure, to the work surface in a linear, circular, elliptical, or random motion, and the like.

A particular embodiment includes an organic surfactant. The water contact angle criterion $W°_g$, for a test substrate ground with an abrasive in the presence of an effective amount of the composition is less than about 20°. Also, the antiloading criterion P for the surfactant is greater than about 0.3. Typically, the organic surfactant is selected from a group consisting of sodium lauryl sulfate, sodium decyl sulfate, sodium octyl sulfate, lauramidopropyl betaine, and sodium lauryl sulfoacetate. In a particular embodiment, the surfactant is sodium lauryl sulfate.

In various embodiments, the first compound is selected to satisfy one or more of the following sets of conditions selected from the group consisting of:

P is greater than about 0.4;

ΔT is greater than about 5° C.;

F is less than about 0.5;

$W^{\circ}_{g}$ is less than $W^{\circ}_{z}$;

$W^{\circ}_{g}$ is less than $W^{\circ}_{z}$, $T_{melt}$ is greater than about 40° C., and F is less than about 0.5;

$W^{\circ}_{g}$ is about equal to W°, $T_{melt}$ is greater than about 40° C., and F is less than about 0.5; and ΔT is greater than about 5° C., F is less than about 0.5, and $W^{\circ}_{g}$ is about equal to W°.

EXEMPLIFICATION

The following examples are provided to illustrate the principles of the embodiments, and are not intended to be limiting in any way.

Example 1

Measurement of Empirical Grinding Performance

A commercial abrasive product that contained no initial antiloading composition, Norton A270 P500 sandpaper (Norton Abrasives, Worcester, Mass.), was employed for all tests. The experimental anti-loading agents (listed in Table 1; obtained from Stepan Company, Northfield, Ill.; except Arquad 2HT-75, Akzo-Nobel, Chicago, Ill.; and Rhodapon LM and Rhodapex PM 603, Rhodia, Cranbury, N.J.) were prepared as 30% solutions by weight in water and coated onto 5 inch (12.7 cm) diameter discs of sandpaper with a sponge brush. A back surface of the discs includes a mating surface comprising hook and loop fastening material. The experimental workpieces were steel panels prepared by painting the steel panels with a paint selected to be representative of a typical primer in the automotive industry, e.g., BASF U28 (BASF Corporation, Mount Olive, N.J.). The workpieces were ground by hand using a hand-held foam pad to which the abrasive disc was attached via the hook and loop fastening material. The downward force exerted on the abrasive against the workpiece was monitored using a single-point load cell (LCAE-45 kg load cell, Omega Engineering, Inc., Stamford, Conn.) mounted underneath a 50 cm×50 cm metal plate. The grinding was performed with the workpiece clamped on top of the metal plate. The downward force was maintained at 11 N±1N by monitoring the output from the load cell. The foam pad was held at an approximately 60° angle relative to an axis projecting normal to the steel panels so that only approximately ⅓ of the abrasive disc's surface was in contact with the workpiece. The resulting pressure at the abrading interface was therefore approximately 2.6 kN/m$^2$.

An approximately 5 cm diameter area of the workpiece was ground with the abrasive. Sanding was performed by back-and-forth motion of the abrasive across the surface of the workpiece that was not previously ground. A rate of sanding of approximately 3 strokes per second was used. The stroke length was approximately 4 cm. The test was performed in 5-second increments for a total of 150 seconds, or to the point where the cut rate dropped to zero, whichever occurred first. Cut rate for each increment was reported using an empirical scale of 4 through zero, where 4 represented a very aggressive cut rate and zero denoted that the product had ceased to cut altogether. The ratings were a result of visual evaluation of the amount of material removed and swarf generated combined with the amount of resistance to lateral motion felt by the operator. A high cut rate was reflected in large amounts of swarf generation and low resistance to lateral motion. Empirical performance G in the test was expressed as the sum of all the cut-rate numbers over the duration of the test. The highest G value that can be achieved in this test can be defined by 4 (maximum cut rate increment)*30 (number of test increments)=120. In Table 1, the empirical performance results were normalized resulting in values for G ranging from 0 to 1. The grinding tests were carried out at three values of substrate temperature $T_{sub}$, e.g., at about 21° C., 32° C., and 43° C. The results are provided in Table 1 under G, normalized to the best performance at about 21° C. The parameters F, ΔT, and P are discussed in Examples 2, 3, and 5, respectively.

Table 2 shows the performance of sandpaper coated with sodium lauryl sulfate (Stepanol VA-100) versus zinc stearate and versus no coating. The total performance of each material is equal to the sum of all ratings over the 150 second test. The values for G, obtained by normalizing relative to the best-performing product in Table 1, are also shown in Table 2. The sandpaper coated with sodium lauryl sulfate performed better than the sandpaper coated with zinc stearate, which in turn performed better than uncoated sandpaper.

Example 2

Measurement of Coefficient of Friction

The coefficient of friction F for a compound was determined by preparing coated samples and measuring the coefficient of friction at about 20° C. Chemicals to be tested were coated by hand onto 0.127 mm (millimeter) polyester film (Melinex®, DuPont Teijin Films, Hopewell, Va.) using a 12.7 cm (centimeter) 8-path wet film applicator (Model AP-25SS, Paul N. Gardner Company, Inc., Pompano Beach, Fla.) with a 0.127 mm gap setting. If the antiloading agent was provided in a liquid solution, it was coated directly. If it was solid and water-soluble, it was dissolved in approximately 10 parts water by weight prior to coating (if the solution was not clear, more water was added and the solution was heated until the solution became clear, indicating that the agent can be fully dissolved). The coating was then allowed to dry inside an oven set at 80° C. for 4 hours to remove at least a portion of any remaining solvents. For zinc stearate, which is a solid at room temperature and is water insoluble, the powder was dispersed into Stoddard solvent (CAS#8052-41-3) and then coated onto the film following the former procedure. The coated material was placed inside an oven at 145° C. for 30 minutes to fuse the stearate powder onto the film. After drying in the oven, all coated samples were conditioned at room temperature for at least 40 hours prior to testing.

Once the samples were prepared, the coefficient of friction was measured by sliding coated material across itself. The apparatus used was a Monitor/Slip & Friction Model 32-26 (Testing Machine, Inc., Amityville, N.Y.). A strip of film coated with the antiloading agent was cut and mounted to fit a 6.35 cm square sled weighing 200 grams. The sled was dragged across another strip of coated film according to the standard test method described in ASTM D 1894-01 (American Society for Testing and Materials, West Conshohocken, Pa.). The strips of coated film were oriented such that the two coated surfaces are in contact as they slide past one another. The F values are provided in Table 1.

TABLE 1

Data Shows Performance of Antiloading Compounds

| Trade Name | Supplier | Chemical Name or Class | F. | $T_{melt}$ (° C.) | ΔT (° C.) | P | G |
|---|---|---|---|---|---|---|---|
| | | $T_{sub}$ = 21° C. | | | | | |
| Stepanol WAT | Stepan | TEA Lauryl Sulfate | 0.98 | 20 | −1 | 0.17 | 0.04 |
| Stepanol WA-100 | Stepan | Sodium Lauryl Sulfate | 0.10 | 96 | 75 | 0.78 | 0.99 |
| Stepanol AM | Stepan | Ammonium Lauryl Sulfate | 0.25 | 30 | 9 | 0.26 | 0.15 |
| Steol CS-460 | Stepan | Sodium Laureth Sulfate | 0.88 | 21 | 0 | 0.18 | 0.07 |
| Rhodapex PS-603 | Rhodia | Sodium C12–C15 Pareth Sulfate | 0.75 | 28 | 7 | 0.26 | 0.17 |
| Polystep B-25 | Stepan | Sodium Decyl Sulfate | 0.07 | 94 | 73 | 0.63 | 1.00 |
| Polystep A-16 | Stepan | Branched sodium dodecylbenzene sulfonate | 0.40 | 46 | 25 | 0.29 | 0.11 |
| Maprosyl 30 | Stepan | Sodium Lauroyl Sarcosinate | 0.17 | 75 | 54 | 0.53 | 0.76 |
| Lathanol LAL | Stepan | Sodium Lauryl Sulfoacetate | 0.20 | 72 | 51 | 0.58 | 0.31 |
| Amphosol LB | Stepan | Lauramidopropyl Betaine | 0.48 | 125 | 104 | 0.47 | 0.47 |
| Ammonyx 4002 | Stepan | Stearalkonium Chloride | 0.32 | 40 | 19 | 0.31 | 0.50 |
| DLG 20A | Ferro | Zinc stearate | 0.18 | 125 | 104 | 0.60 | 0.71 |
| | | $T_{sub}$ = 32° C. | | | | | |
| Stepanol WA-100 | Stepan | Sodium Lauryl Sulfate | 0.10 | 96 | 64 | 0.71 | 0.60 |
| Polystep A-16 | Stepan | Branched sodium dodecylbenzene sulfonate | 0.40 | 46 | 14 | 0.24 | 0.07 |
| Maprosyl 30 | Stepan | Sodium Lauroyl Sarcosinate | 0.17 | 75 | 43 | 0.47 | 0.53 |
| Lathanol LAL | Stepan | Sodium Lauryl Sulfoacetate | 0.20 | 72 | 40 | 0.51 | 0.28 |
| Amphosol LB | Stepan | Lauramidopropyl Betaine | 0.48 | 125 | 93 | 0.47 | 0.31 |
| Ammonyx 4002 | Stepan | Stearalkonium Chloride | 0.32 | 40 | 8 | 0.24 | 0.46 |
| DLG 20A | Ferro | Zinc stearate | 0.18 | 125 | 93 | 0.54 | 0.67 |
| | | $T_{sub}$ = 43° C. | | | | | |
| Stepanol WAT | Stepan | TEA Lauryl Sulfate | 0.98 | 20 | −23 | −0.10 | 0.04 |
| Stepanol WA-100 | Stepan | Sodium Lauryl Sulfate | 0.10 | 96 | 53 | 0.64 | 0.76 |
| Stepanol AM | Stepan | Ammonium Lauryl Sulfate | 0.25 | 30 | −13 | 0.06 | 0.10 |
| Steol CS-460 | Stepan | Sodium Laureth Sulfate | 0.88 | 21 | −22 | −0.09 | 0.08 |
| Rhodapex PS-603 | Rhodia | Sodium C12–C15 Pareth Sulfate | 0.75 | 28 | −15 | 0.00 | 0.11 |
| Polystep B-25 | Stepan | Sodium Decyl Sulfate | 0.07 | 94 | 51 | 0.53 | 0.67 |
| Polystep A-16 | Stepan | Branched sodium dodecylbenzene sulfonate | 0.40 | 46 | 3 | 0.20 | 0.07 |
| Maprosyl 30 | Stepan | Sodium Lauroyl Sarcosinate | 0.17 | 75 | 32 | 0.41 | 0.61 |
| Lathanol LAL | Stepan | Sodium Lauryl Sulfoacetate | 0.20 | 72 | 29 | 0.43 | 0.19 |
| Amphosol LB | Stepan | Lauramidopropyl Betaine | 0.48 | 125 | 82 | 0.46 | 0.32 |
| Ammonyx 4002 | Stepan | Stearalkonium Chloride | 0.32 | 40 | −3 | 0.16 | 0.10 |
| DLG 20A | Ferro | Zinc stearate | 0.18 | 125 | 82 | 0.542 | 0.63 |

TABLE 2

Data Shows Performance Relative to Uncoated Abrasive ($T_{sub}$ = 43° C.)

| Time (s) | Stepanol WA-100 | Zinc Stearate | Reference |
|---|---|---|---|
| 5 | 4 | 4 | 4 |
| 10 | 4 | 4 | 4 |
| 15 | 3 | 4 | 4 |
| 20 | 3 | 3 | 3 |
| 25 | 3 | 3 | 3 |
| 30 | 3 | 3 | 3 |
| 35 | 3 | 3 | 2 |
| 40 | 3 | 2 | 2 |
| 45 | 2 | 2 | 1 |
| 50 | 2 | 2 | 1 |
| 55 | 2 | 1 | 1 |
| 60 | 2 | 1 | 1 |
| 65 | 2 | 1 | 0 |
| 70 | 2 | 1 | |
| 75 | 2 | 1 | |
| 80 | 2 | 1 | |
| 85 | 2 | 1 | |
| 90 | 1 | 1 | |
| 95 | 1 | 1 | |
| 100 | 1 | 0 | |
| 105 | 1 | | |
| 110 | 1 | | |
| 115 | 1 | | |
| 120 | 1 | | |
| 125 | 1 | | |
| 130 | 1 | | |
| 135 | 1 | | |

TABLE 2-continued

Data Shows Performance Relative to Uncoated Abrasive ($T_{sub}$ = 43° C.)

| Time (s) | Stepanol WA-100 | Zinc Stearate | Reference |
|---|---|---|---|
| 140 | 1 | | |
| 145 | 0 | | |
| 150 | | | |
| Total | 55 | 39 | 29 |
| G rating | 0.76 | 0.54 | 0.40 |

Key
4 Aggressive
3 Good
2 Fair
1 Poor
0 No cut

Example 3

DSC Measurement of Melting Points

A sample of approximately 5 mg of each experimental antiloading compound was loaded into a differential scanning calorimeter sample cell (model DSC 2910 TA Instruments New Castle, Del.), and the temperature was increased until the melting point was observed. The value for each compound is reported in Table 1 as $T_{melt}$, along with ΔT calculated from $T_{melt}-T_{sub}$.

Example 4

Water Contact Angle of Compounds Shows Superior Compounds 1.3 cm-wide strips of steel coated with DuPont U28 primer were ground offhand with Norton A270 P500 for 20 seconds at a pressure of 66 kN/m$^2$ with A270 P500 sandpaper coated with each experimental antiloading compound, and the water contact angle was measured with a VCA 2500XE goniometer (AST Products, Inc, Billerica, Mass.). Six readings were taken for each ground surface. The water contact angle $W°_g$ for each compound is reported in Table 3. FIG. 1 illustrates, for example, water contact angles for values of W° less than 90°, equal to 90°, and greater than 90°.

The data illustrate that the water contact angle W° increases after abrasion to with a sandpaper coated with zinc stearate, e.g., to $W°_z$. However, after sanding with certain antiloading compounds such as Stepanol WA-100 and Ammonyx 4002, the water contact angle, e.g., $W°_g$, can be reduced to about 0°.

TABLE 3

Water Contact Angles Resulting from Abrasion with Antiloading Agents

| Compound | W° |
|---|---|
| Stepanol WA-100 | 0.0 |
| Ammonyx 4002 | 0.0 |
| Arquad 2HT-75 | 48.7 |
| Amphosol LB | 60.2 |
| Lathanol LAL | 66.2 |
| Polystep B-25 | 99.2 |
| Maprosyl 30 | 108.2 |
| Zinc Stearate | 133.7 |
| Substrate | 106.4 |

Example 5

Grinding Model Predicts Variation in Antiloading Performance

Figure 2:
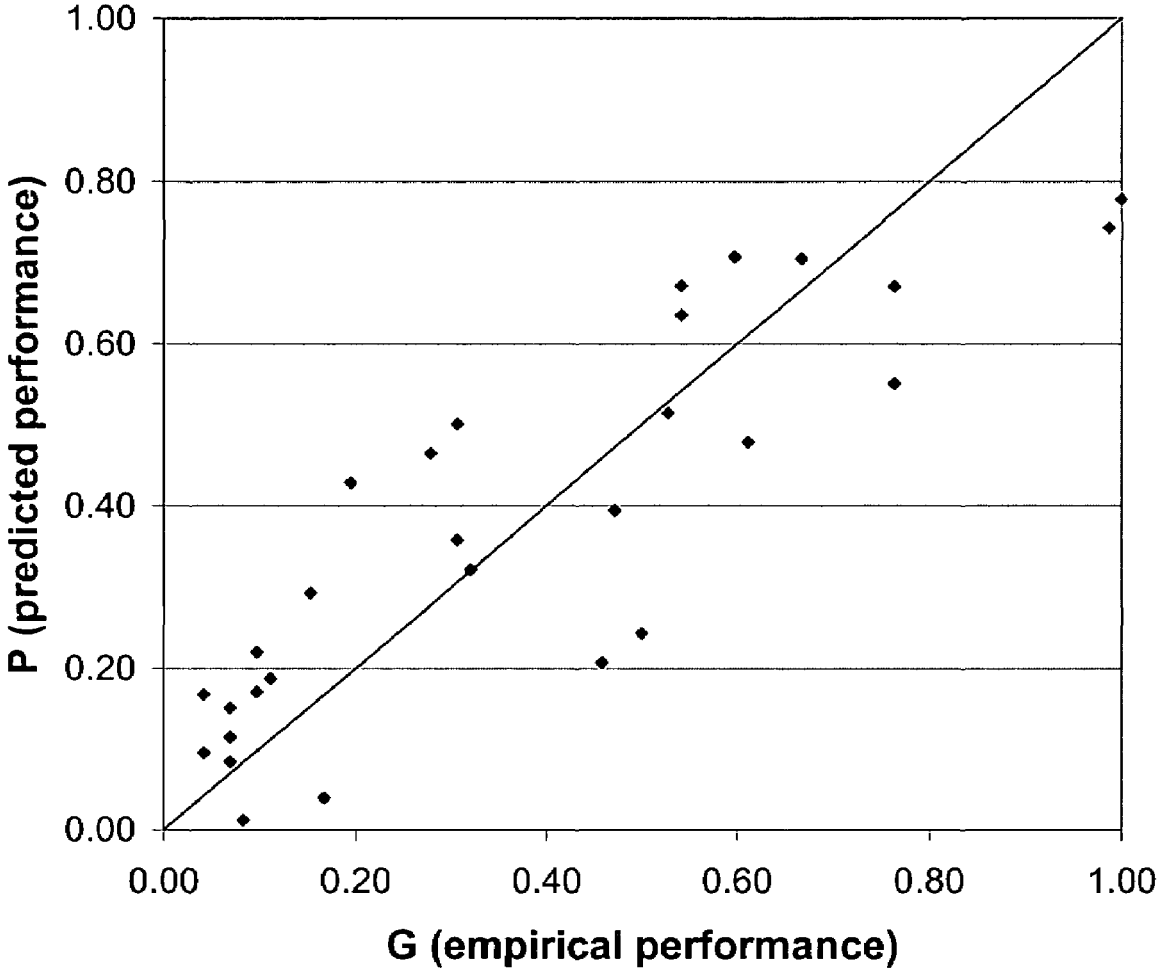
FIG. 2 is a plot of antiloading criterion P versus empirical grinding performance G.

A regression analysis was performed, employing empirical values F and ΔT as the independent variables and the relative grinding performance G as the dependent variable. Using this approach, Eq. 1 for calculated performance P was obtained. Table 1 shows the empirical G values versus the calculated P values. Table 4 shows the statistics of the regression analysis, reflecting the model's ability to account for up to about 75% of the variation in the data. FIG. 2 shows a plot of P versus G.

TABLE 4

Grinding Performance Model Explains Variation in Data

| Parameter | Estimate | Standard Error | T Statistic | P-Value |
|---|---|---|---|---|
| CONSTANT | 0.68 | 0.097 | 6.96 | $1.74 * 10^{-7}$ |
| F | −2.07 | 0.432 | −4.78 | $5.45 * 10^{-5}$ |

TABLE 4-continued

Grinding Performance Model Explains Variation in Data

| Parameter | Estimate | Standard Error | T Statistic | P-Value |
|---|---|---|---|---|
| ΔT | $3.28 * 10^{-3}$ | $8.60 * 10^{-4}$ | 3.81 | $7.28 * 10^{-4}$ |
| $F^2$ | 1.58 | 0.408 | 3.88 | $6.12 * 10^{-4}$ |

$R^2$= 0.75;
adjusted $R^2$= 0.72;
standard error of estimate = 0.15

While this invention has been particularly shown and described with references to various embodiments thereof, it will be understood by those skilled in the art that various changes in form and details may be made therein without departing from the scope of the invention encompassed by the appended claims.

What is claimed is:

1. An abrasive product, comprising:

a binder support substrate;

a binder;

an abrasive material affixed to the support substrate by the binder; and an antiloading composition comprising a first organic compound and a second organic compound, wherein each of the first and second organic compounds independently:

has a water contact angle criterion $W°_g$ that is less than a water contact angle $W°_z$ for zinc stearate; and satisfies at least one condition selected from the group consisting of a melting point $T_{melt}$ greater than about 40° C., a dynamic coefficient of friction F less than about 0.4, and an antiloading criterion P greater than about 0.2, and wherein the first and second organic compounds are different, and wherein each of the first and second organic compounds independently is represented by a formula selected from the group consisting of $R—OSO_3^-M^+$, $RCONH(CH_2)_3N^+(CH_3)_2CH_2COO^-$, $R—CONR'CH_2CO_2^-M^+$, and $R—O(CO)CH_2OSO_3^-M^+$, wherein R is C6–C18 linear alkyl;

R' is C1–C4 linear alkyl; and $M^+$ is an alkali metal ion.

2. The abrasive product of claim 1, wherein the first compound has $W°_g$ less than about 100° and satisfies at least one condition selected from the group consisting Of $T_{melt}$ greater than about 70° C., F less than about 0.4, and P greater than about 0.2.

3. The abrasive product of claim 1, wherein the first compound has $W°_g$ less than about 70° and satisfies at least one condition selected from the group consisting Of $T_{melt}$ greater than about 90° C., F less than about 0.3, and P greater than about 0.3.

4. The abrasive product of claim 1, wherein $W°_g$ for the first compound is about 0°.

5. The abrasive product claim 1, wherein the first compound is selected from the group consisting of sodium lauryl sulfate, sodium decyl sulfate, sodium octyl sulfate, sodium lauroyl sarcosinate, lauramidopropyl betaine, and sodium lauryl sulfoacetate.

6. The abrasive product of claim 1, wherein the first compound is sodium lauryl sulfate.

* * * * *

UNITED STATES PATENT AND TRADEMARK OFFICE

CERTIFICATE OF CORRECTION

PATENT NO. : 7,195,658 B2
APPLICATION NO. : 10/688833
DATED : March 27, 2007
INVENTOR(S) : Gwo S. Swei, Damien C. Nevoret and Patrick Yang It is certified that error appears in the above-identified patent and that said Letters Patent is hereby corrected as shown below:

Column 6
Lines 24-25, delete "$R–O(CO)CH_2OSO_3^-M^+$" and insert --$R–O(CO)CH_2SO_3^-M^+$--.

Column 12
Lines 40-41, delete "$R–O(CO)CH_2OSO_3^-M^+$" and insert --$R–O(CO)CH_2SO_3^-M^+$--.

Signed and Sealed this

Fourteenth Day of April, 2009

John Doll

JOHN DOLL
*Acting Director of the United States Patent and Trademark Office*